US006021607A

United States Patent [19]

Angove

[11] Patent Number: 6,021,607

[45] Date of Patent: Feb. 8, 2000

[54] AUTOMATIC DOOR CLOSING DEVICE

[76] Inventor: Garret Angove, P.O. Box 682, North Falmouth, Mass. 02556

[21] Appl. No.: 09/225,093

[22] Filed: Jan. 4, 1999

[51] Int. Cl.[7] ..... E05D 15/06

[52] U.S. Cl. ..... 49/404; 49/137; 16/78

[58] Field of Search ..... 49/404, 138, 137; 16/76, 77

[56] References Cited

U.S. PATENT DOCUMENTS 2,947,534 8/1960 Leimer et al. ..... 49/138
5,630,249 5/1997 Rebai ..... 16/78
5,771,636 6/1998 Mathis ..... 49/139

*Primary Examiner*—Jerry Redman
*Attorney, Agent, or Firm*—Thomas A. Kahrl, Esq.

[57] ABSTRACT

A door closing device including closing means for urging a door between said first open position and second closed position having a cable mounted in a housing said cable wound about periphery of a reel regulating the speed of movement of said door between the open position and closed position; a reservoir for containing viscous fluid; and a buffer for retarding the speed of movement of said door comprising an impeller immersed in the viscous fluid for use as a brake; whereby the impeller reduces rotational speed of said reel, thus reducing closing speed of said door.

7 Claims, 7 Drawing Sheets

AUTOMATIC DOOR CLOSING DEVICE

BACKGROUND—FIELD OF INVENTION

This invention relates to a door closing device for use in a sliding type door.

BACKGROUND—DISCUSSION OF PRIOR ART

This invention relates to a door closing device for automatically returning sliding closure to a predetermined position within a stationary frame, and more particularly to a type thereof wherein a biasing means, such as a spiral spring, keeps the door in closing direction thereof and a buffer mechanism, comprising an impeller immersed in a viscous fluid, is provided to moderate closing speed of door.

Door closing means have already been proposed in which spring energy accumulated in a spring member is released to close the sliding door, utilizing various types of buffer mechanisms to regulate the closing speed of the door. U.S. Pat. No. 4,097,957 Kitutaka, Jul. 4, 1978, utilizes a piston and cylinder, charged with oil, as a buffer, requiring high precision machined parts thereby making it prohibitively expensive to manufacture. U.S. Pat. No. 4,884,369 Tatham, Dec. 5, 1989, utilizes a weight with a pneumatic seal disposed in a hollow cylinder as a buffer mechanism, but excessive force is required to open the door to overcome the combined forces of the weight, spring, door, and friction. U.S. Pat. No. 4,301,623 Demukai, Nov. 24, 1981, has a braking means comprised of magnetic surfaces opposed to each other on the upper frame of the door. This mechanism requires precise alignment of said magnetic surfaces for consistent moderation of door closing speed. The rate of door closing speed cannot easily be adjusted when factors such as thermal expansion and wear warrant. U.S. Pat. No. 4,757,642 utilizes a spring loaded plunger in intimate contact with the spring member, this means and other similar contact type brakes are prone to slip-stick thereby resulting in varying closing speeds and a tendency to get stuck before closure is completed.

The heretofore known door closing devices suffer from one or more of the following disadvantages:

a) closing force is difficult to adjust or cannot be adjusted.

b) speed of door closure is difficult to adjust or cannot be adjusted.

c) the door closing device is large and/or bulky.

d) installation is difficult and/or requires precise setting or alignment of components to operate properly.

e) existing door and/or door frame must be drastically altered to accommodate device.

f) inefficiency of braking means requires excessive spring force when door is closing, thereby requiring excessive force by the consumer to open the door.

g) braking means prone to slip-stick thereby increasing chance of door getting stuck before completing closure.

h) quantity of components, nature of components, or precision of components is expensive to manufacture therefore selling price will be prohibitive.

i) components or assembly not weatherproof therefore factors such as rain, ice, snow, and temperature could adversely affect performance.

j) the device cannot be disabled and enabled easily.

k) complexity of the design is prone to failure.

The most telling indication of the lack of effectiveness of the heretofore known door closing devices is the lack of visibility in the marketplace.

OBJECTS AND ADVANTAGES

Accordingly, several of the objects and advantages of the present invention are:

a) to provide a simple, inexpensive, reliable, compact door closer.

b) to provide a door closer that can be used on existing sliding doors.

c) to provide a door closer with variable closing force and closing speed.

d) to provide a door closer utilizing an efficient closure regulating means thereby reducing the opening force required.

e) to provide a door closer to prevent small children, pets, insects, and pests from unwanted egress and ingress.

f) to provide a door closer that can be easily installed, without special tools or methods, by the average consumer.

g) to provide a door closer that can quickly and easily be disabled for manual operation or enabled for automatic closure.

Further objects and advantages will become apparent from a consideration of the ensuing description and drawings.

DRAWING FIGURES

DETAILED DESCRIPTION OF THE INVENTION

Figure 1:
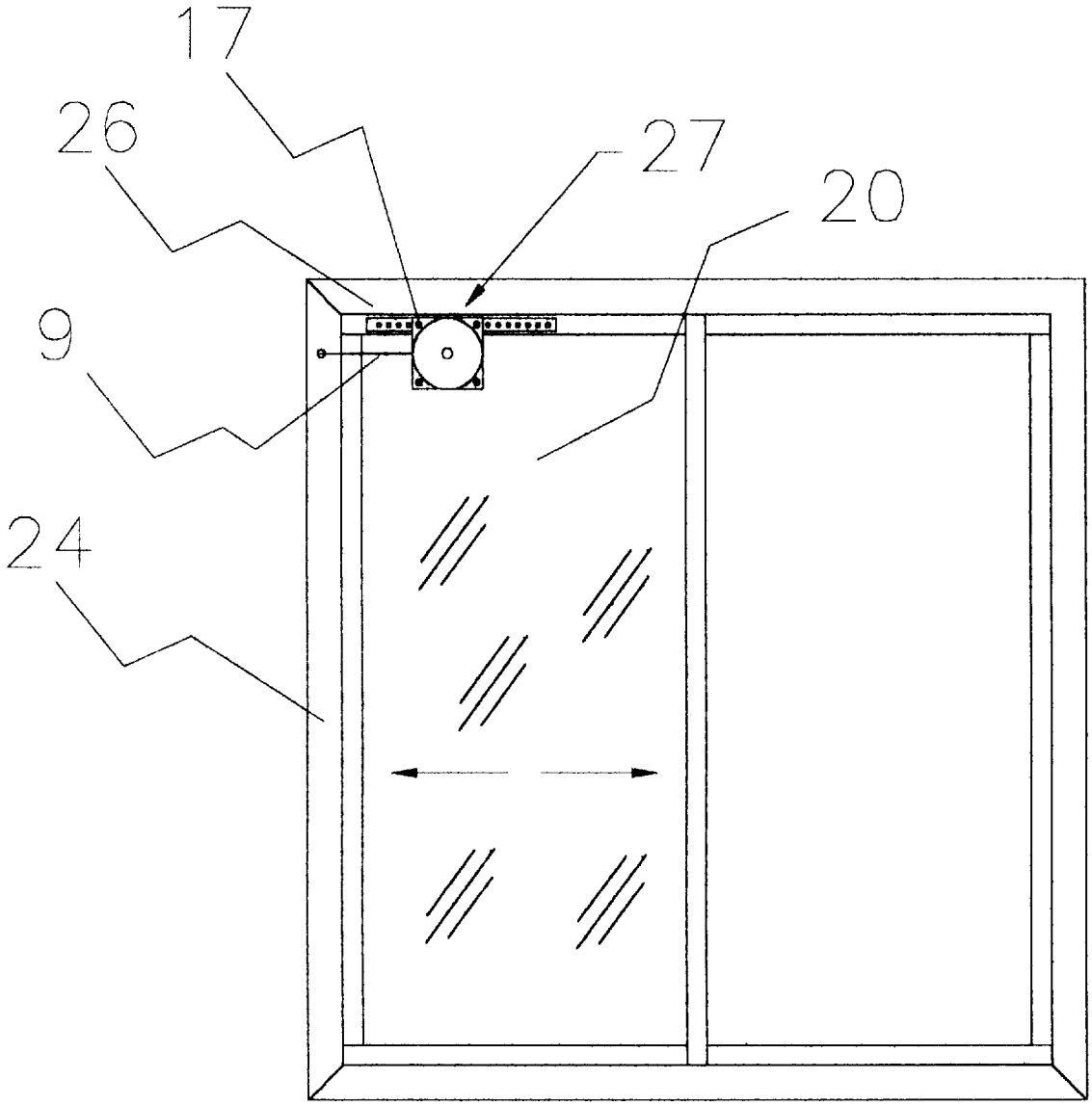
FIG. 1 shows a front view of a sliding door to which the automatic door closing device according to the present invention is attached, the sliding door is in the closed position.
Figure 2:
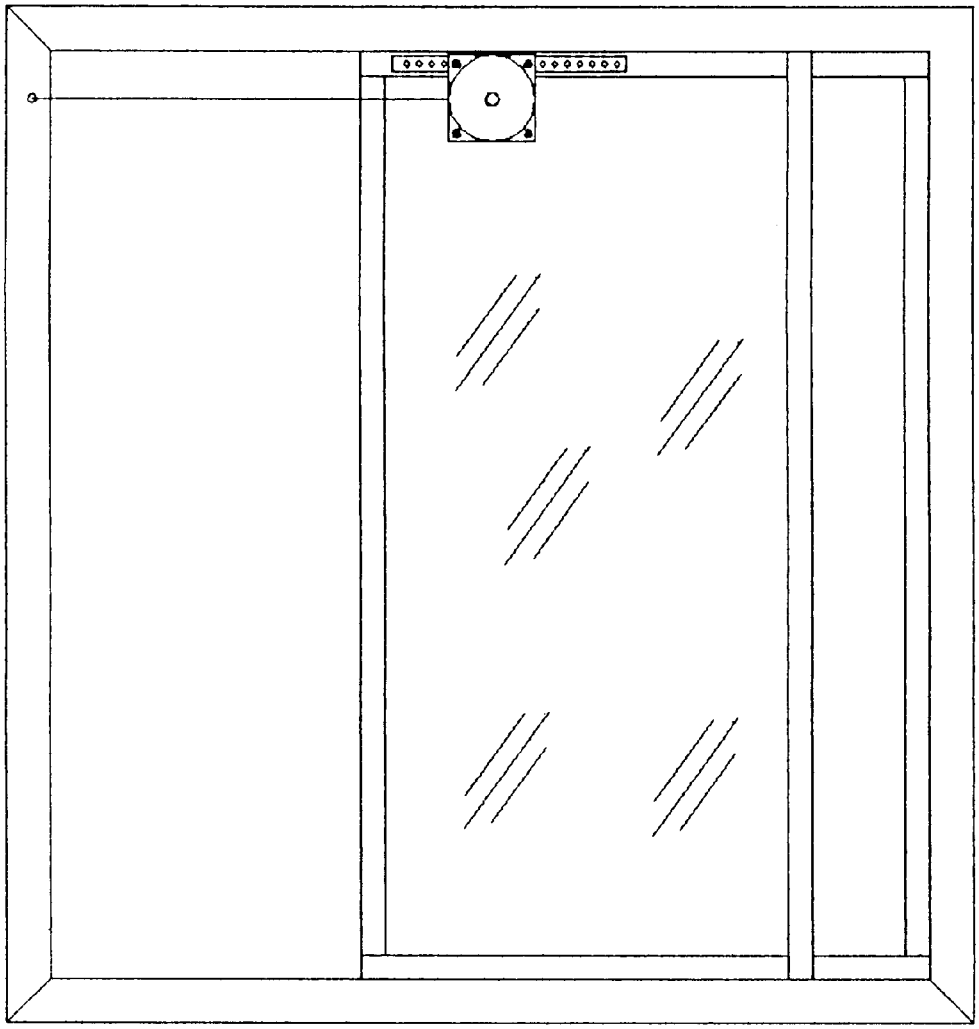
FIG. 2 shows the sliding door of FIG. 1 in the open position.
Figure 3:
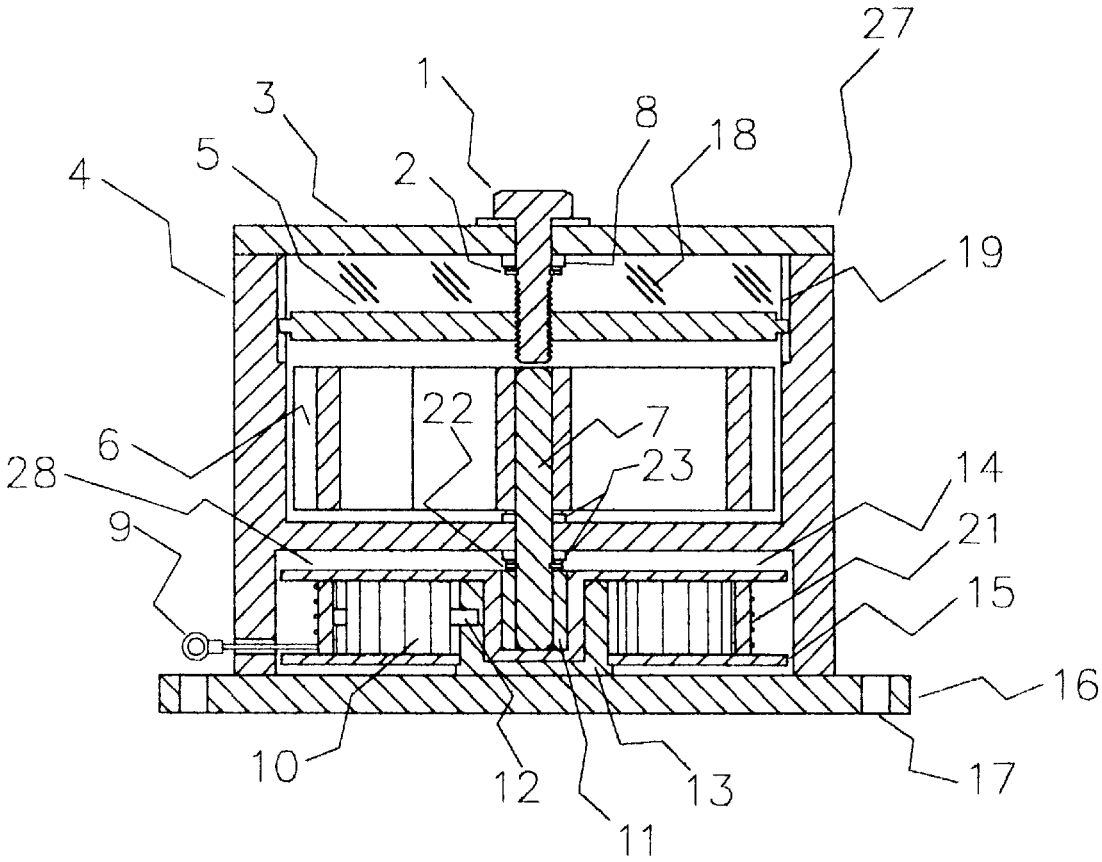
FIG. 3 shows a sectional view showing the automatic door closing device of FIG. 1 according to the present invention.
Figure 4:
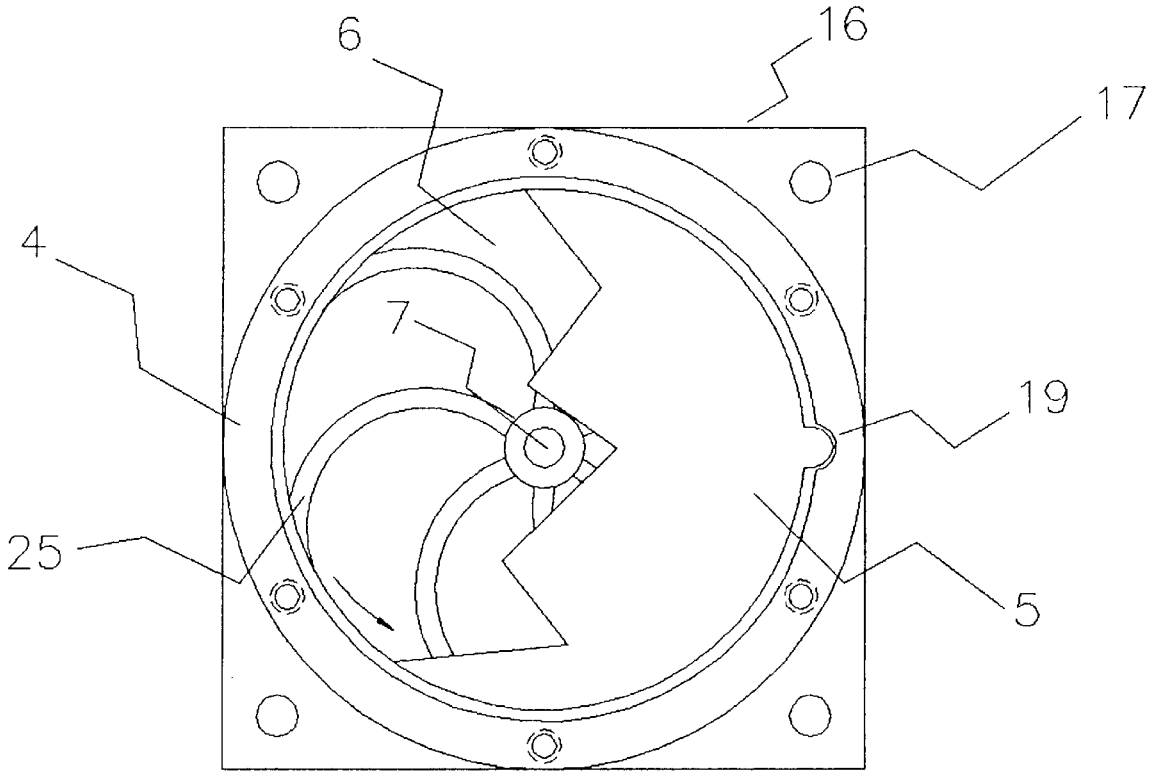
FIG. 4 shows a view of the speed adjusting plate of the door closer of FIG. 1 and the viscous fluid reservoir of the housing, the cover plate has been removed and the adjusting plate is cutaway to provide a partial top view of the impeller.
Figure 5:
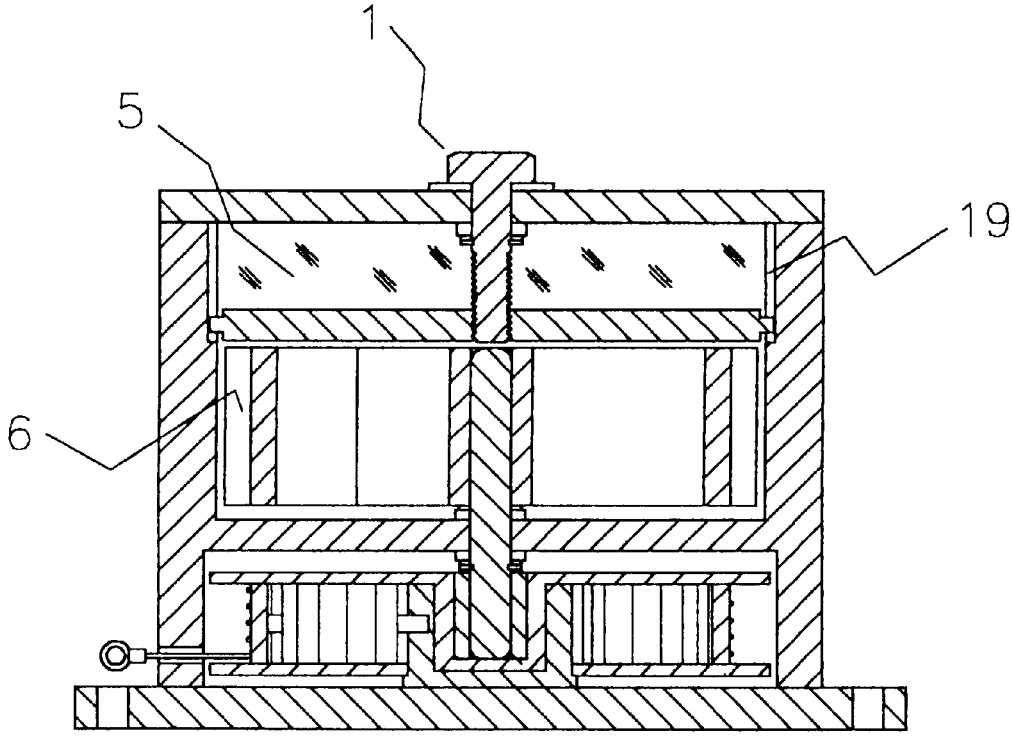
FIG. 5 shows a sectional view of the automatic door closing device of FIG. 1 with the adjusting plate in the fully extended position.

Referring now to the drawing FIGS. 1–6, and initially to FIG. 3 thereof, there is illustrated the preferred embodiment of an automatic door closing device 27 for a sliding door 20 which comprises a spring reel assembly 28 type of driving section coupled to a buffer mechanism that utilizes an impeller 6 immersed in a viscous fluid 18. Spring reel assembly 28 consists of a spring member 10 contained within a cylinder 21, top reel plate 14 and bottom reel plate 15. The inner end of spring member 10 is fixed to a nonrotating spring reel shaft 13 by a means such as a pin 12 and its outer end is fixed to a cylinder 21 by a suitable means, the aforementioned spring reel shaft 13 is attached to bottom plate 16 by a suitable means thus holding spring reel assembly 28 in place. The unit comprised of cylinder 21, top reel plate 14 and bottom reel plate 15 rotates about spring reel shaft 13 as spring 10 winds and unwinds, and cable 9 is taken up and let out. Cable 9 is fixed to the outer periphery of cylinder 21 and is wound around the same.

An impeller shaft 7 is fixed to an impeller 6 and extends into a clutch bearing 11 that is fixed within top reel plate 14. A snap ring 22 prevents lateral movement of impeller shaft 7. Oil seals 23 prevent fluid leakage into the cavity housing spring reel assembly 28.

The upper portion of housing 4 contains the aforementioned impeller 6 immersed in a viscous fluid 18, the fluid completely fills the upper portion of housing 4. An adjusting plate 5 is suspended in the viscous fluid 18 by means of the adjusting screw 1. Adjusting plate 5 is prevented from rotating by means of bosses on said adjusting plate that protrude into antirotation notches 19. Adjusting screw 1 extends through the cover plate 3, is threaded through adjusting plate 5 and is held in place by a snap ring 2 in contact with oil seal 8.

OPERATION—FIGS. 1, 2, 3, 4, 5, 6

The automatic door closing device 27 is attached to sliding door 20 with the end of cable 9 attached to a hook on door frame 24 as shown in FIG. 1. A mounting bracket 26 is attached to the upper portion of sliding door 20, door closing device 27 is attached to mounting bracket 26 at appropriate location along the length using two mounting holes 17. Four mounting holes 17 are provided to allow right hand or left hand mounting. The mounting of the automatic door closing device 27 is such that when sliding door 20 is in the closed position there is sufficient tension in the spring 10 holding sliding door 20 in the closed position.

In operation, when sliding door 20 is opened as shown in FIG. 2, cable 9 is drawn out of the housing 4 causing spring reel assembly 28 FIG. 3 to rotate. Thus, spring 10 is wound tightly around the stationary spring reel shaft 13. The clutch bearing 11 is free-rolling in one direction, as cable 9 is drawn out and spring reel assembly 28 rotates, impeller shaft 7 remains stationary.

When the opened door is released, the force of the wound spring 10 rotates spring reel assembly 28 in the opposite direction, thus closing the door. As the door begins to close the rotation of spring reel assembly 28 causes clutch bearing 11 in top reel plate 14 to lock on to impeller shaft 7 thereby causing impeller shaft 7 and impeller 6 to rotate. Viscous fluid 18 slows the rotation of impeller 6 thereby acting as a buffer to slow the speed that spring reel assembly 28 rewinds the cable 9, thereby slowing the speed of door.

Figure 6:
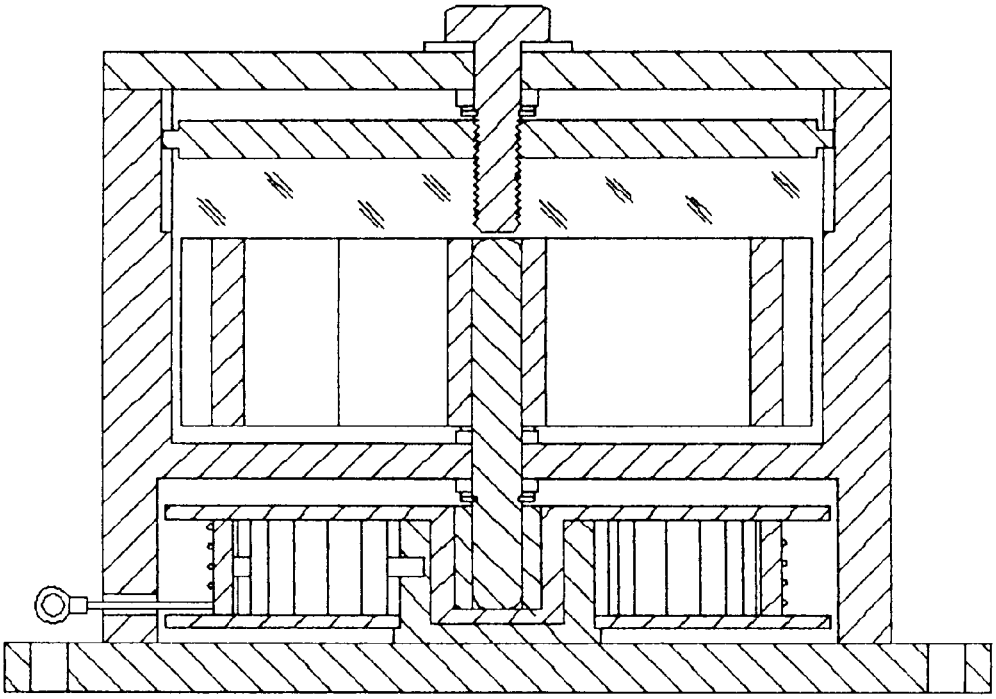
FIG. 6 shows a sectional view of the automatic door closing device of FIG. 1 with the adjusting plate in the fully retracted position.

Adjusting screw 1 is threaded into the adjusting plate 5 such that when adjusting screw 1 is turned, adjusting plate 5 will move up or down, antirotation channels 19 in housing 4 wall prevent adjusting plate 5 from rotating and also prevent the same from contacting impeller 6. The adjusting plate 5 changes the speed of door closure, the closer adjusting plate 5 is to impeller 6 FIG. 5, the slower the rate of door closure; by restricting viscous fluid 18 there is more resistance on impeller 6 causing spring reel assembly 28 to turn slower, thus reeling in cable 9 slower thereby slowing door closure. Increasing the distance between adjusting plate 5 and impeller 6 as shown in FIG. 6, increases the rate of door closure, viscous fluid 18 is allowed to flow over the top of impeller 6 blades thereby reducing the total resistance on impeller 6. Thus impeller 6 turns faster along with all subsequent connected parts.

Regarding various of the parameters of the buffer mechanism, the lower the viscosity of the viscous liquid 18, the lesser will be the resistance on the impeller 6, and thus the speed of door closure will be greater. The proximity of the adjusting plate 5 and the interior housing wall to the impeller 6 will also affect door closing speed; the greater the clearances between the aforementioned parts, the less the resistance on impeller 6, thus the greater the speed of closure. Additionally, the total area of the impeller blade 25 faces on the resistance side of impeller blades 25, shown as concave faces in FIG. 4, will also determine door closing speed. Thus, he greater the area, determined by the number and shape of impeller blades 25, the greater the resistance thus the slower the speed of door closure.

Automatic door closing device 27 is designed to be used on many different types of sliding doors. The doors will vary in two critical ways; weight and frictional resistance to sliding. Spring tension must be adjustable to compensate for these factors such that there will be sufficient force to close heavier doors and/or doors with high frictional resistance. Lighter doors and/or doors with low frictional resistance will require lower spring forces for closure and, excess spring tension will require more effort to open said doors. To address this issue an adjustable spring tension device is utilized to set spring tension such that the minimum force required to close the door can be selected. This is accomplished by means of mounting bracket 26 that mounts on the frame of the sliding door. The bracket is of sufficient length to allow the door closing device to be locked or screwed in place at different locations along the length of the bracket. The result is that the initial tension in the spring reel will be increased as the mounting location of the door closer moves against the spring force. Conversely the initial spring tension will decrease as the mounting location moves with the spring force. The result is that the initial spring tension can be adjusted to the optimum level for each sliding door application.

Figure 7:
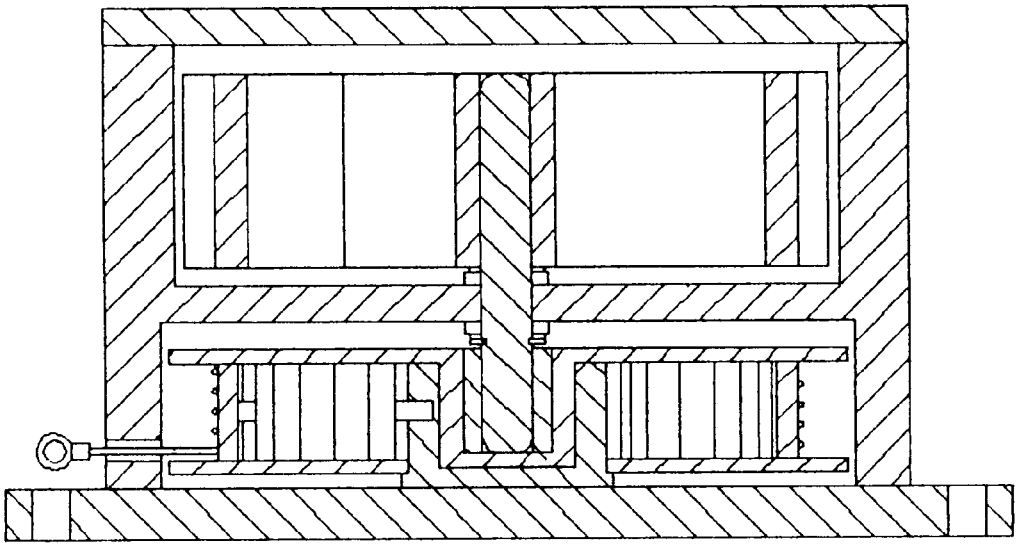
FIG. 7 shows a sectional view of an alternate embodiment of the invention without the adjusting plate and the adjusting screw.

FIG. 7 shows an alternate embodiment of the automatic door closing device in which the adjusting screw and adjusting plate have been deleted and the fluid chamber has been reduced in size. This embodiment is a more compact, simplified and economical version. This generic version has a nonadjustable buffer mechanism that will work on most sliding doors but will not allow the user to adjust the closing speed of the sliding door.

CONCLUSIONS, RAMIFICATIONS, AND SCOPE

Accordingly, the reader will see that this invention provides a highly reliable, simple, and effective sliding door closing device. Furthermore, the device has the additional advantages in that

- it is adaptable to existing sliding doors using commonly found household tools (a drill and a screwdriver) without disfiguring said sliding door.
- it provides a sliding door closer that is resistant to weather, dirt, and dust, by virtue of all moving parts being totally enclosed; and placement of the door closer at the top of the door, away from incidental exposure to contaminants.
- it provides a means of regulating the rate of door closure thus allowing the user to adjust closing speed as desired.
- it provides an efficient buffer mechanism with low frictional resistance that minimizes the force required by the biasing mechanism for door closure, thus minimizing the effort required to open the sliding door.
- it provides a sliding door closer that by automatically closing upon release of the sliding door, prevents unwanted egress or ingress of small children, pets, insects, and pests. Also, due to the force required to open the door, small children will be prevented from ingress or egress.

it provides a sliding door closer that can be disabled quickly by simply unhooking the cable, thus in situations that automatic door closure is not desired it can be readily disabled or enabled as needed.

it provides a sliding door closer that has few moving parts and is inexpensive to manufacture.

Although the description above contains many specificities, these should not be construed as limiting the scope of the invention but merely as providing illustrations of preferred embodiments of this invention. For example, the parts of the invention can have other configurations or shapes than those depicted; instead of using a spring reel a similarly functioning device utilizing spring energy can be used; a means to adjust spring tension, such as by drawing out more cable or a mechanism to rotate the spring reel shaft, can be added thereby affecting closing and opening force.

LIST OF REFERENCE NUMERALS

1 Adjusting screw
2 Snap ring
3 Cover plate
4 Housing
5 Adjusting plate
6 Impeller
7 Impeller shaft
8 Oil seal
9 Cable
10 Spring
11 Clutch
12 Pin
13 Spring reel shaft
14 Top reel plate
15 Bottom reel plate
16 Bottom plate
17 Mounting hole
18 Viscous fluid
19 Antirotation channel
20 Sliding door
21 Cylinder
22 Snap ring
23 Oil seals
24 Snap ring
25 Impeller blades
26 Mounting bracket
27 Automatic door closing device
28 Spring reel assembly

What is claimed is:

1. A door closing device comprising:

a) a sliding door mounted for lateral movement between a first closed position and a second open position;

b) a housing fixed securely to said sliding door;

c) a cable having one end fixed securely to a frame containing said sliding door and the other end of said cable fixed securely to a rotating reel contained in said housing, said cable wound about periphery of said reel;

d) a biasing means fixed securely to said reel for biasing in one rotational direction, said cable being unwound against the biasing force of said biasing means; and e) a braking means comprised of an impeller immersed in a viscous fluid, contained in a liquid tight chamber within said housing, said impeller coupled to said reel by a connecting means allowing said cable to be unwound from reel without rotating said impeller, said connecting means engaging said impeller when said cable is wound about said reel whereby said impeller reduces rotational speed of said reel, thus reducing closing speed of said sliding door.

2. A door closing device comprising:

a) a door mounted on a frame for lateral movement on tracks between a first open position and a second closed position;

b) closing means for urging said door between said first open position ad second closed position having a housing and comprising a cable having one end fixed securely to the frame containing said door and the other end of said cable fixed securely to a rotating reel contained in said housing, said cable wound about periphery of said reel;

c) means for mounting said closing means on said tracks;

d) means for regulating the speed of movement of said door between the open position and closed position; comprising buffer means for retarding the speed of movement of said door, biasing means for changing speed of closure and reservoir means for containing viscous fluid; and f) said buffer means comprising an impeller immersed in said viscous fluid for use as a brake of said closing means; whereby said buffer means reduces rotational speed of said reel thus reducing closing speed of said door.

3. The door closing device of claim 2 wherein the closing means comprises said biasing means fixed securely to said reel for biasing in one rotational direction, said cable being unwound against the biasing force of said biasing means.

4. The door closing device of claim 2 wherein said means for regulating the speed of movement comprises a) said buffer means immersed in said viscous fluid contained in a liquid tight chamber within said housing.

5. The door closing device of claim 4 wherein said impeller is coupled to said reel by a connecting means allowing said cable to be unwound from said reel without rotating said impeller, said connecting means engaging said impeller when said cable is wound about said reel.

6. The door closing device as defined in claim 4, wherein said liquid tight chamber comprises:

a) a plate substantially the same diameter as said impeller, said plate threaded to a screw protruding through said housing; and b) turning said screw to adjust proximity of said plate to face of said impeller causing pressure of said viscous fluid against said impeller to change causing speed of rotation of said reel to increase or decrease, thereby changing closing speed of said sliding door.

7. The automatic door closing device as defined in claim 6, means for mounting and securing said housing to said sliding door is comprised of:

a) a bracket securely fixed to said sliding door, said bracket of sufficient length to allow said housing to be fixed at any of a plurality of points along the length of said bracket; and b) mounting location of said housing on said bracket determines initial tension of said biasing means and resultant tension closure of said sliding door, wherein said tension is adjustable to compensate for frictional forces and weight of said sliding door thus providing a minimum required tension of said biasing means to completely close said sliding door.

* * * * *